250-506.1 SR
6/5/84 OR 4,453,081

United States Patent [19]
Christ et al.

[11] 4,453,081
[45] Jun. 5, 1984

[54] CONTAINER FOR THE TRANSPORTATION AND/OR STORAGE OF RADIOACTIVE MATERIAL

[75] Inventors: Richard Christ, Bruchköbel; Klaus Wegner; Hartmut Kroll, both of Hanau, all of Fed. Rep. of Germany

[73] Assignee: Transnuklear GmbH, Hanau, Fed. Rep. of Germany

[21] Appl. No.: 248,440

[22] Filed: Mar. 27, 1981

[30] Foreign Application Priority Data

Mar. 29, 1980 [DE] Fed. Rep. of Germany ..... 3012256

[51] Int. Cl.[3] ..... G21F 5/00
[52] U.S. Cl. ..... 250/506.1; 250/515.1
[58] Field of Search ..... 250/506, 515; 376/272

[56] References Cited

U.S. PATENT DOCUMENTS 4,225,467 9/1980 McMurtry et al. ..... 372/339
4,272,683 6/1981 Baatz et al. ..... 250/506

FOREIGN PATENT DOCUMENTS 36954 10/1981 European Pat. Off. ..... 250/506.1

*Primary Examiner*—Bruce C. Anderson
*Attorney, Agent, or Firm*—Cushman, Darby & Cushman

[57] ABSTRACT

There are needed containers having an n-shielding for the transportation and storage or radioactive materials, especially irradiated fuel elements, which containers still remain intact even in extreme accidents and guarantees a good dissipation of heat. This is attained with containers which there is additionally arranged an n-shielding layer of a graphite material between the base body and the inner covering.

22 Claims, 3 Drawing Figures

CONTAINER FOR THE TRANSPORTATION AND/OR STORAGE OF RADIOACTIVE MATERIAL

BACKGROUND OF THE INVENTION

The invention is directed to a container for the transportation and/or storage of radioactive materials which emit γ- and n-radiation and produce noteworthy residual heat consisting of a container body having a shielding function for γ- and n-radiation and an inner cover.

Container which are employed for the transportation and/or storage of spent fuel elements must safely confine the radioactivity of the inserted goods and prove in rigorous tests that this is also guaranteed in extreme accident situations. However, simultaneously they must also shield off the gamma and neutron rays set free in the radioactive decay reactions and lead off the heat of decay to the outside. The shielding function must be substantially maintained even after accident caused stresses.

Known shielding containers for the most part consist of a metallic base container and which have the necessary wall strength for the shielding of the gamma rays, customarily made of steel or a combination of lead and steel, and an outer shell of neutron shielding material with a high portion of water or in the form of a water jacket.

The disadvantage in these constructions is that even slight collisions of the containers, as can occur even in routine operation, can lead to damage of the neutron shielding and then make necessary an expensive, total repair of the entire container. In a severe accident, characterized by high impact strength and the action of fire this neutron shielding can fail to work and increase the dosage attained in the environment of the container.

While the metallic γ-shielding wall is preserved according to experience in severe accidents, the outer laying neutron shielding fails because of the mechanical and thermal influences with the result of a corresponding increase of the neutron loading of the environment.

Therefore it was the problem of the present invention to develop a container for the transportation and/or storage of radioactive materials, especially for irradiated nuclear fuel elements and highly active waste consisting of a base body having a shielding function for γ- and n-radiation and an inner coating of corrosion resistant material which has a further n-shielding stable to the effects of the external accidents in order to still maintain sufficient shielding effect in the event of the loss of the external shielding. This additional shielding action, however, should not prevent the drawing off of the heat of decay from the inner space of the container.

SUMMARY OF THE INVENTION

This problem is solved according to the invention by additionally arranging an n-shielding in the form of a material based on graphite between the inner covering and the base body.

Through the positioning of the additional n-shielding according to the invention within the solid base body there is guaranteed the best possible protection from mechanical and thermal damages. The use of graphite according to the invention with its moderating property effects an additional n-shielding and simultaneously fulfills the requirement of good thermal conductivity. Furthermore, there is obtained an excellent resistance at elevated temperatures, as are present in normal operation of the container and particularly in the action of an accidental fire.

The n-shielding layers on the outside of the base body and the inner n-shielding of the invention can be so dimensioned that according to the requirement the internal or external shielding layer produces the preponderant contribution to the shielding against neutron rays under normal operating conditions.

The container can comprise, consist essentially of or consist of the elements set forth.

DETAILED DESCRIPTION

Figure 1:
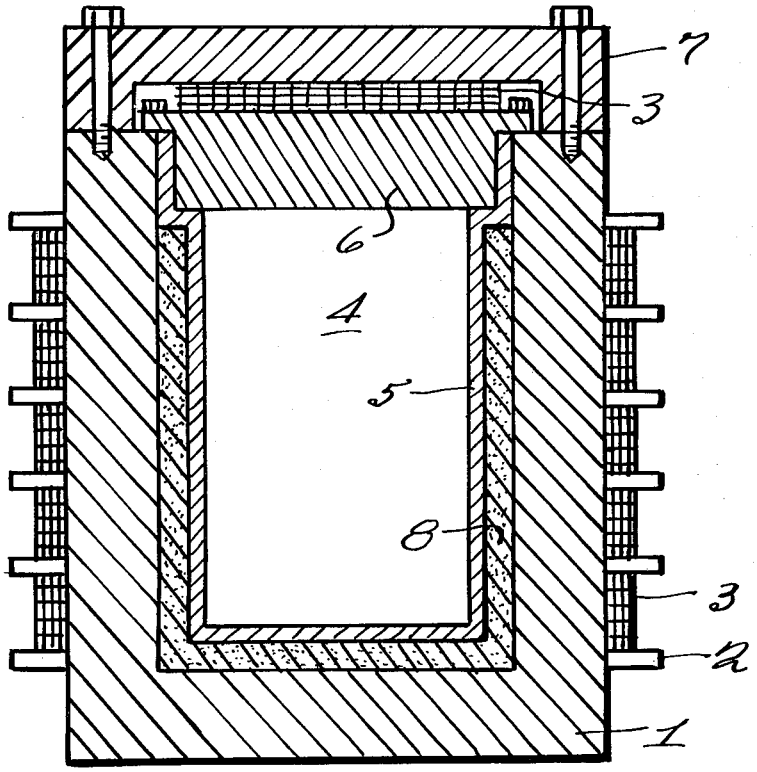
FIGS. 1, 2, 3 schematically show in section the container of the invention and further explains the invention.
Figure 2:
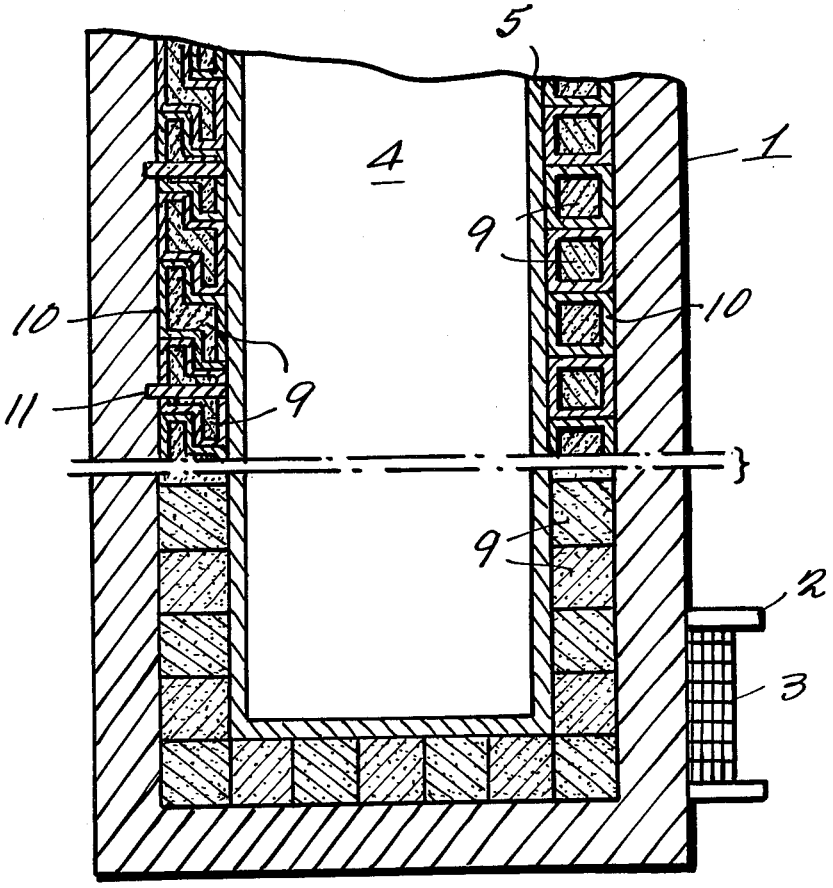
Figure 3:
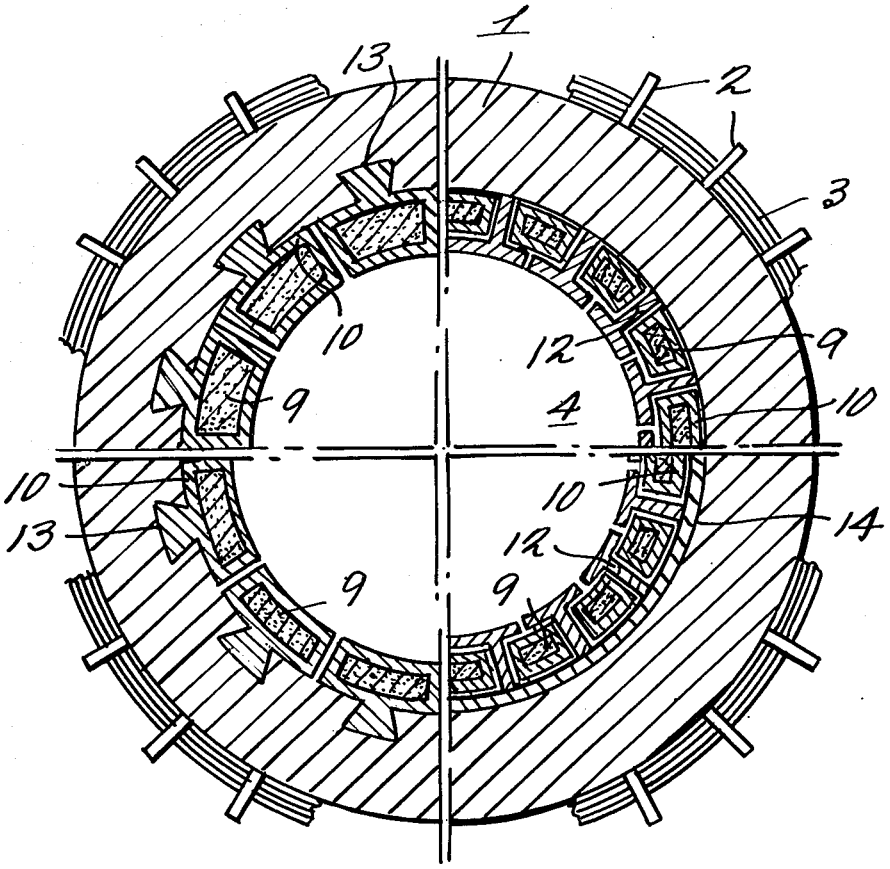

Referring more specifically to the drawings where like numerals refer to like parts the transportation and/or storage container consists of a base body 1, for example of steel, in which there are arranged in known manner cooling fins 2 and an external n-shielding 3. The inner space 4 of the container for receiving the radioactive material is formed of the inner covering 5 of corrosion resistant material, for example stainless steel, and a shielding cover 6 which on its outside likewise carries n-shielding 3. The cover zone is protected against mechanical and thermal effects through a dome 7.

In the annular space between the covering 5 and the base body 1 there is arranged additionally an n-shielding layer 8 of a material based on graphite as, further neutron shielding.

The shielding layer 8 based on graphite preferably consists of a mixture of graphite powder and a hardenable binder, as for example waterglass (sodium silicate) or above all, a casting resin, e.g. phenol-formaldehyde.

This mixture can either be applied as such in the annular space between base body 1 and inner covering 5 and hardened or there can advantageously be employed preformed shaped graphite pieces 9, e.g. of the type of plaster composite which are adjusted to the dimensions of the space. Thereby these shaped pieces also are covered with a metal jacket 10, preferably of neutron absorbing material. It is also possible to press a stampable graphite composition into the annular space.

It has proven especially advantageous to improve the rate of entrance for neutron by admixing neutron poisons with the graphite composition, preferably boron in the form of $B_4C$ powder. Furthermore, it is advantageous to join the inner coating 5 with the base body 1 by tension rods 11.

The function of the inner coating 5 in special cases can be advantageously taken care of by the metal jacket 10 covered shaped graphite pieces 9. The separate inner covering 5 can then be partially or completely eliminated. The shaped graphite pieces 9 are then particularly favorably fastened on the inner side of the base body 1, for example by guide strips 12. However, the same purpose is also fulfilled by other types of fasteners, as e.g. dovetail guides 13 in the base 1 or fastenings, e.g. to a sheet 14.

The shielding layer 8 can be easily adjusted through interchanging different thickness shaped graphite pieces 9 according to the requirements.

The entire disclosure of German priority application No. P 3012256.6-33 is hereby incorporated by reference.

We claim:

1. A container suitable for the transportation or storage of radioactive materials, particularly irradiated nuclear fuel elements and highly active waste consisting essentially of a base body having a first shielding means for γ- and n-radiation and an internal covering of corrosion resistant material and having a second n-shielding layer, said second shielding layer being between the internal covering and the base body and being made of a graphite containing material, consisting essentially of a hardened mixture of graphite powder and a binder.

2. A container according to claim 1 wherein the binder is a cast resin.

3. A container according to claim 1 wherein the second shielding layer comprises shaped pieces of graphite.

4. A container according to claim 3 wherein the shaped pieces of graphite are covered by a metal jacket.

5. A container according to claim 4 wherein the metal jacket also serves as the internal covering.

6. A container according to claim 5 wherein the shaped graphite pieces are secured to the inner side of the base body.

7. A container according to claim 4 wherein the shaped graphite pieces are secured to the inner side of the base body.

8. A container according to claim 3 wherein the shaped graphite pieces are secured to the inner side of the base body.

9. A container according to claim 8 wherein the graphite has a neutron absorbing material admixed therewith.

10. A container according to claim 7 wherein the graphite has a neutron absorbing material admixed therewith.

11. A container according to claim 6 wherein the graphite has a neutron absorbing material admixed therewith.

12. A container according to claim 4 wherein the graphite has a neutron absorbing material admixed therewith.

13. A container according to claim 3 wherein the graphite has a neutron absorbing material admixed therewith.

14. A container according to claim 2 wherein the graphite has a neutron absorbing material admixed therewith.

15. A container according to claim 1 wherein the graphite has a neutron absorbing material admixed therewith.

16. A container according to claim 15 wherein the neutron absorbing material is boron carbide powder.

17. A container according to claim 13 wherein the neutron absorbing material is boron carbide powder.

18. A container according to claim 12 wherein the neutron absorbing material is boron carbide powder.

19. A container according to claim 11 wherein the neutron absorbing material is boron carbide powder.

20. A container according to claim 10 wherein the neutron absorbing material is boron carbide powder.

21. A container according to claim 20 wherein the internal covering is secured to the base body by tension rods.

22. A container according to claim 1 wherein the internal covering is secured to the base body by tension rods.

* * * * *